US006270314B1

(12) United States Patent
Nomoto

(10) Patent No.: US 6,270,314 B1
(45) Date of Patent: Aug. 7, 2001

(54) WATER PUMP FOR AN INTERNAL COMBUSTION ENGINE

(75) Inventor: Yuji Nomoto, Kanagawa-ken (JP)

(73) Assignee: Unisa Jecs Corporation, Kanagawa-Ken (JP)

( * ) Notice: Subject to any disclaimer, the term of this patent is extended or adjusted under 35 U.S.C. 154(b) by 0 days.

(21) Appl. No.: 09/397,149

(22) Filed: Sep. 16, 1999

(30) Foreign Application Priority Data

Sep. 16, 1998 (JP) ..... 10-261681

(51) Int. Cl.[7] ..... F04D 29/16

(52) U.S. Cl. ..... 415/172.1; 415/173.1; 415/206

(58) Field of Search ..... 415/170.1, 173.1, 415/172.1, 203, 204, 206

(56) References Cited

U.S. PATENT DOCUMENTS 3,153,382 * 10/1964 Blarcom, Jr. ..... 417/423.3
3,620,642 * 11/1971 Studebaker ..... 415/204
3,741,679 * 6/1973 Johnston ..... 415/172.1

FOREIGN PATENT DOCUMENTS 11125118 5/1999 (JP) .

* cited by examiner

*Primary Examiner*—Edward K. Look
*Assistant Examiner*—Ninh Nguyen
(74) *Attorney, Agent, or Firm*—Sughrue, Mion, Zinn, Macpeak & Seas, PLLC

(57) ABSTRACT

A water pump for an internal combustion engine having a pump casing and a pump cover that forms a circulation cavity. A plate is positioned interface of the pump casing and the pump cover and divides the circulation cavity into an inlet passage and an outlet passage and has a seal portion that seals against the leakage between the inlet passage and the outlet passage of a gap of the interface of the pump casing and the pump cover.

15 Claims, 4 Drawing Sheets

WATER PUMP FOR AN INTERNAL COMBUSTION ENGINE

BACKGROUND OF THE INVENTION

This invention relates to a water pump and, in particular, a water pump that is disposed in a cooling passage that provides cooling for an internal combustion engine.

Many different types of such water pump have been proposed. One such pump has the cooling passage formed by combining a pump casing with a pump cover. An example is the water pump disclosed in Japanese unexamined publication (koukai)11-125118. There the water pump includes a plate that is disposed for dividing a water circulation cavity into an inlet passage and an outlet passage. The plate is formed of a thin metal material and is disposed between the pump casing and the pump cover. However, if a force holding the plate in position is weak, it is possible for a gap to occur between the pump casing, the pump cover, and the plate. In such case, the plate can not divide the outlet passage from the inlet passage. For example, a difference in a pressure between the inlet passage and the outlet passage causes the coolant to leak within the water circulation cavity between the inlet passage and the outlet passage. Namely, the coolant flowing in the outlet passage might leak to the inlet passage through the gap. As a result, the leakage reduces the efficiency of the pump.

It is, therefor, a principal object of this invention to provide an improved and high efficiency water pump for an internal combustion engine that prevents leakage in the water circulation cavity.

SUMMARY OF THE INVENTION

A first feature of this invention concerns the design of a water pump for an internal combustion engine having a single circulation cavity for water. A pump casing and a pump cover form a single circulation cavity therein, and a plate is disposed on a interface of them. The plate divides the circulation cavity into an inlet passage and an outlet passage. The plate has a seal portion that prevents a gap formed between the inlet passage and the outlet passage and leakage.

Another feature of this invention concerns the design of a water pump with a seal portion for a plate that is formed by a bent part of the plate so that a sealing contact is made on the interface of the pump casing and the pump cover. The plate can be made of a thin metal plate or a thin synthetic resin and is disposed at the interface of the pump casing and the pump cover and effectively divides the circulation cavity into the inlet passage and the outlet passage. Therefore, we obtain the water pump that prevents the leaking a coolant from the gap and improves the efficiency of the water pump for an internal combustion engine. The seal portion is formed of a bent part of the plate, so this invention is simple and easily formed.

DETAILED DESCRIPTION OF THE PREFERRED EMBODIMENT OF THE INVENTION

Figure 1:
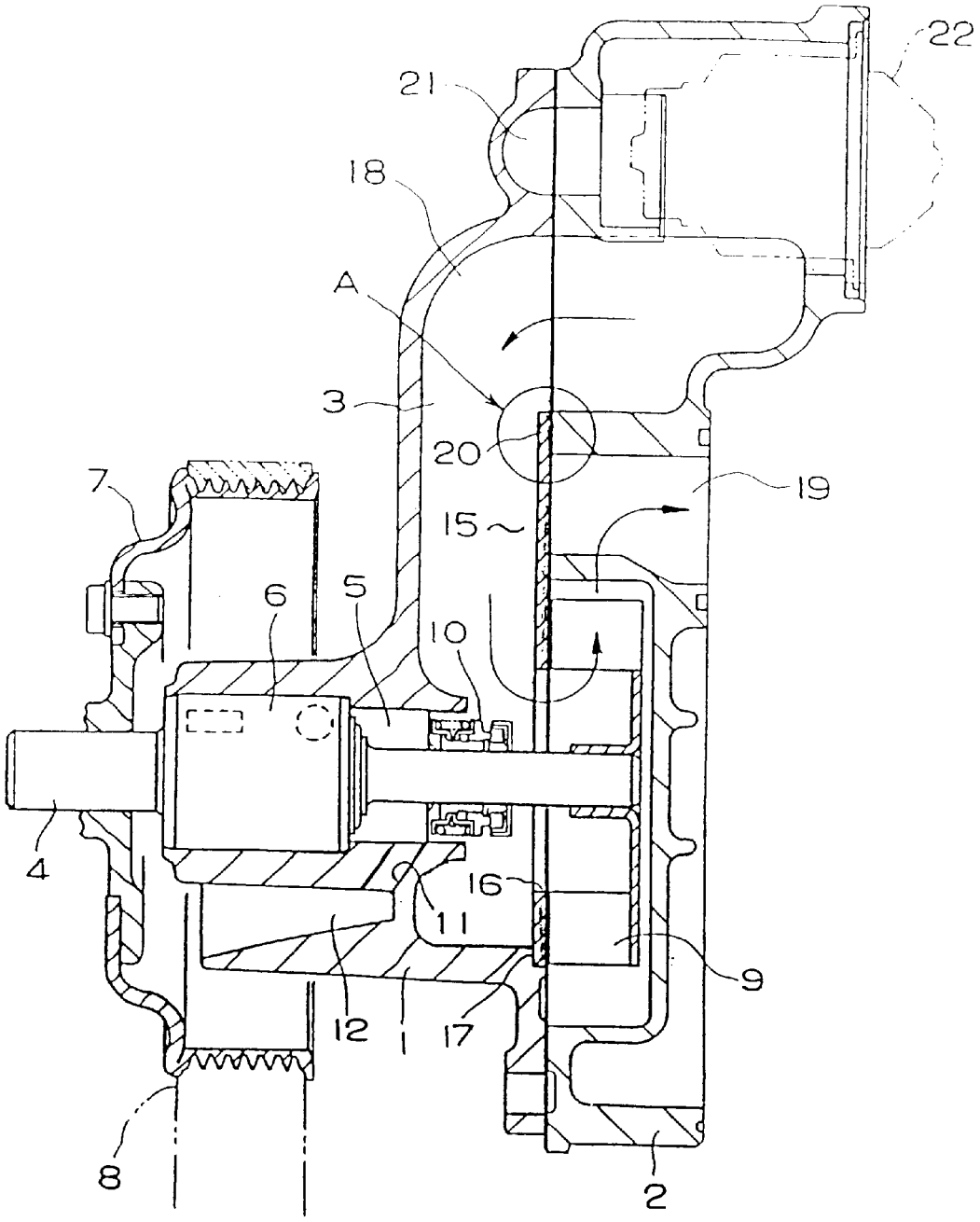
FIG. 1 is a sectional drawing, showing a water pump for internal combustion engine in accordance with the invention.
Figure 2:
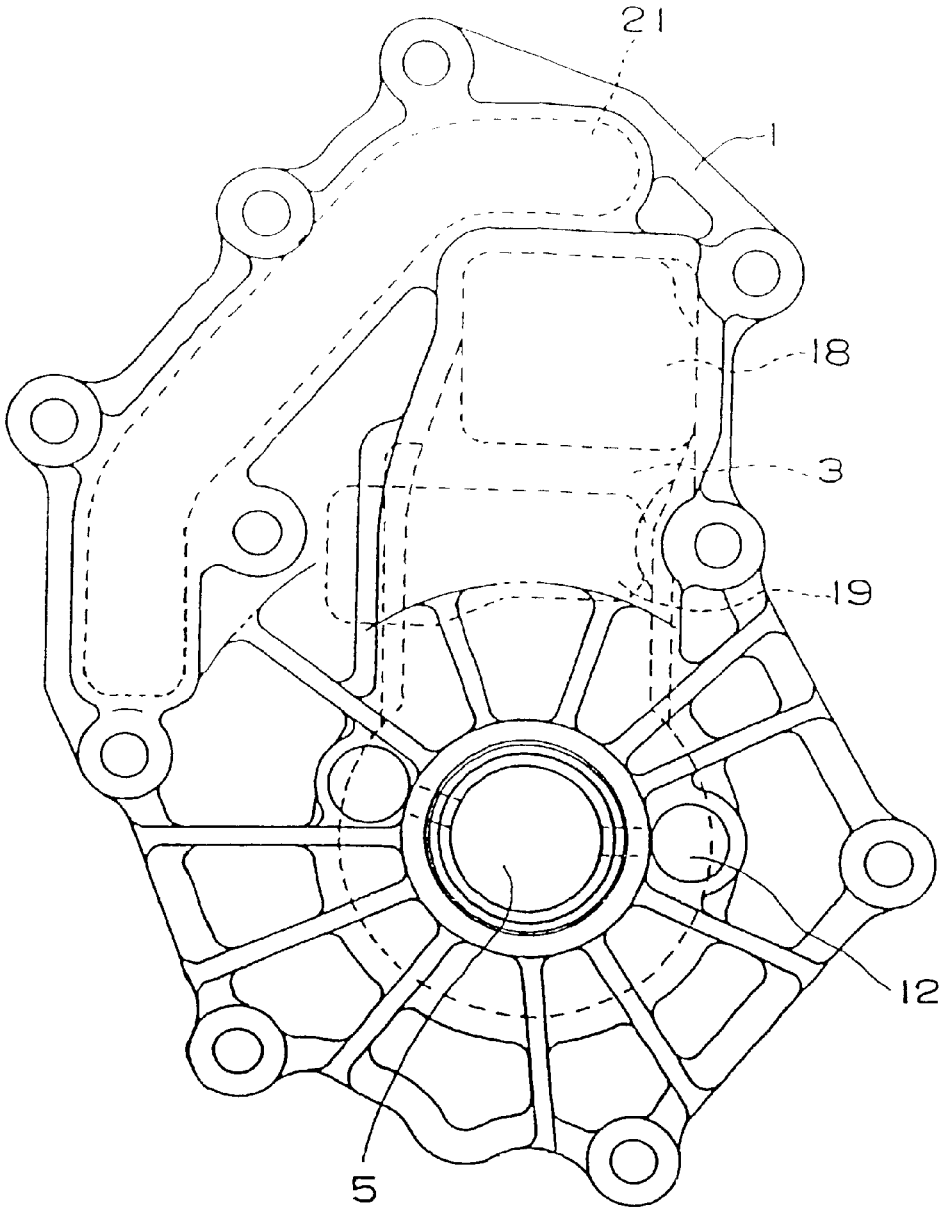
FIG. 2 is a right side view of a pump casing in FIG. 1.

Referring now in detail to the drawings and initially to FIG. 1, in the illustrated embodiment, a pump casing 1 is affixed to a pump cover 2 and they form a circulation cavity 3 in which water on a coolant flows. Both the casing 1 and the cover 2 are cast of aluminum, or some other material, or alternatively, formed by powder metallurgy, and have matching recesses and contact surface at their interface, shown by the solid line in the Figure. For efficient manufacture and assembly, there is no separation of the circulation cavity 3 into inlet passage 18 and an outlet passage 19 solely by the casing 1 and the cover 2 when they are made.

A shaft 4 is extended through a hole 5 of the pump casing 1 and is rotatably supported on a bearing 6 of the pump casing 1. A pulley 7 is fixedly mounted on an end of the shaft 4 that extends outside of the casing 1 and is surrounded by a belt 8 driven by the internal combustion engine. Rotational torque is transmitted to the shaft 4 from pulley 7 which is rotated by belt 8. A pump impeller 9 is secured to the other end of the shaft 4 disposed inside of the pump casing 1 and within the circulation cavity 3, which is filled with coolant. Since the pump impeller 9 is disposed in the circulation cavity 3, when the impeller is rotated, the coolant in the circulation cavity 3 is moved in the direction of the arrow. A mechanical seal 10 is disposed between the hole 5 and the circulation cavity 3 in order to separate the hole 5 from the circulation cavity 3 where the coolant flows. The hole 5 is opened to atmosphere via a drain hole 11 and a drain passage 12.

Figure 3:
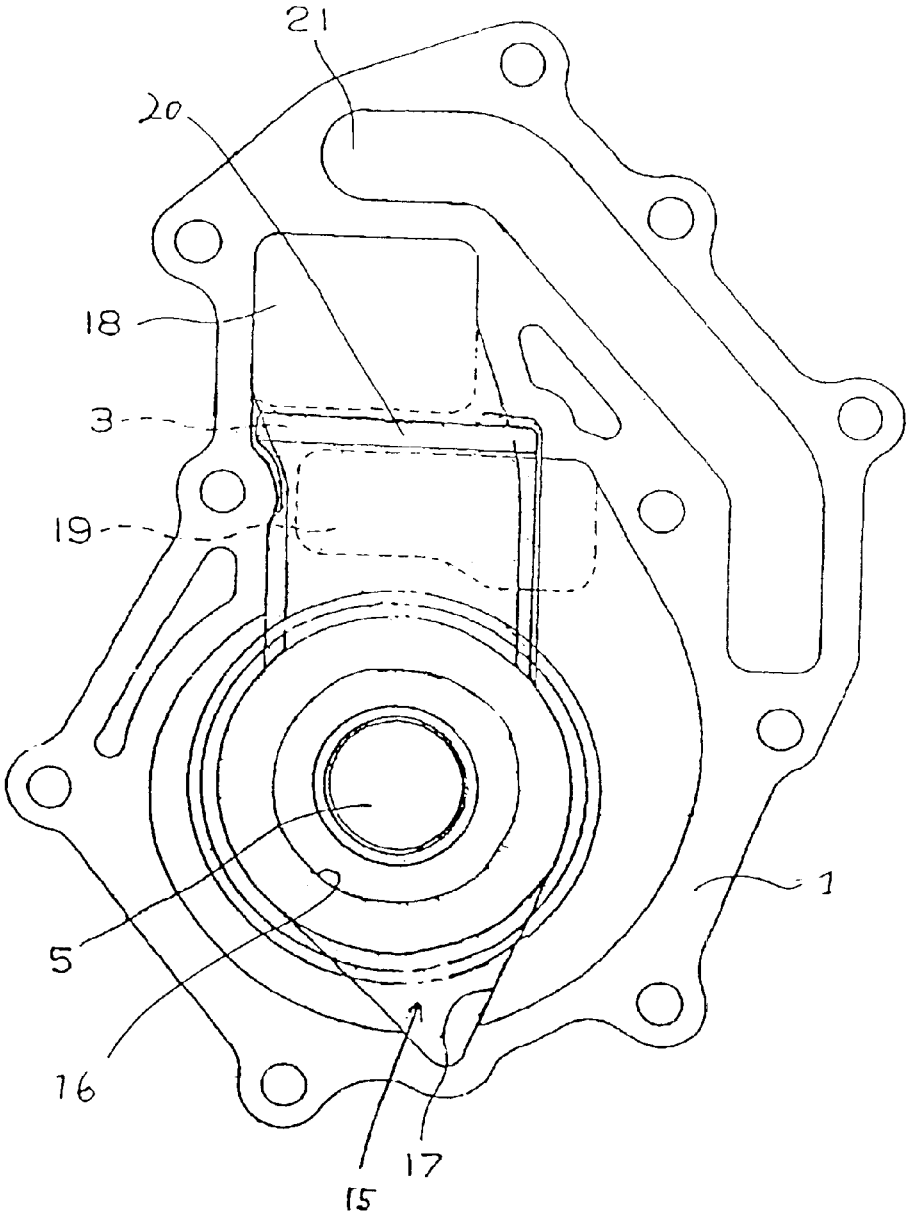
FIG. 3 is a left side view of a pump casing in FIG. 1, showing a plate is rested on the pump casing.

A plate 15 is disposed on the interface of the pump casing 1 and pump cover 2 and is formed from a thin metal plate or a thin synthetic resin. In detail, the plate 15 has an opening hole 16 through which the shaft 4 is extended. As shown in FIG. 3, the plate 15 at its periphery is fit into a concave portion 17 which is formed on a portion of the pump casing 1 that faces to the pump cover 2. Consequently, the plate 15 divides the circulation cavity 3 into an inlet passage 18 and an outlet passage 19. The inlet passage 18 is connected to a radiator (not shown) and the outlet passage 19 is connected to a cylinder jacket (not shown). A by-pass passage 21 bypasses the radiator and is connected from the cylinder jacket to the inlet passage 18. A thermostat 22 shuts the flow of coolant from the radiator to the inlet passage 18 according to a temperature of the coolant.

The plate 15 has a seal portion 20 which seals against leakage that is leaked from the outlet passage 19 to the inlet passage 18 through the gap that is occurs at the interface of the pump casing 1 and the pump cover 2. As showing in FIGS. 4 to 6, the seal portion 20 is a bent part of the plate 15. That bent portion of the plate 15 is shaped so that it tightly contacts the pump cover 2.

Figure 4:
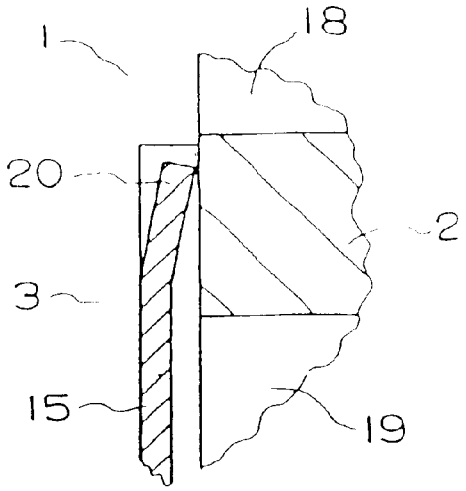
FIG. 4 is an enlarged view of the portion A in FIG. 1.
Figure 5:
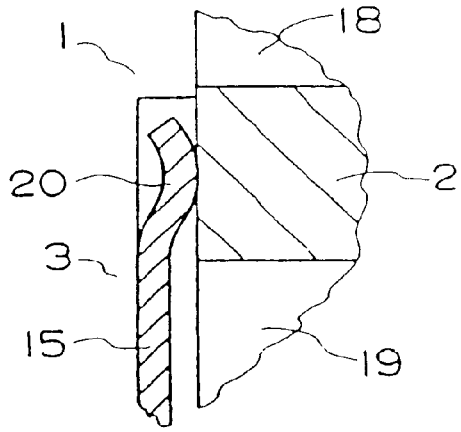
FIG. 5 is in similar to FIG. 4, showing a seal portion of another embodiment of the invention.
Figure 6:
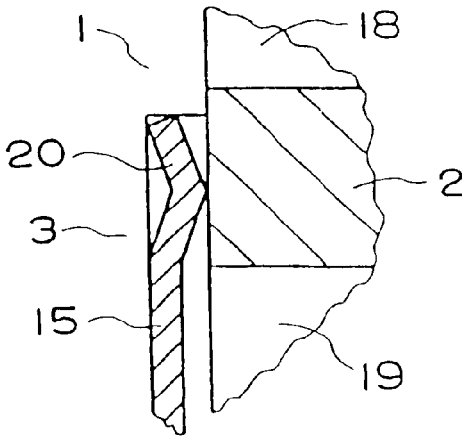
FIG. 6 is in similar to FIG. 4, showing a seal portion of another embodiment of the invention.

In embodiment, as shown in FIG. 4, the seal portion 20 includes a portion that is bent at an end of the plate 15, inclining toward the pump cover 2, so as to tightly contact the pump cover 2. This effectively seals the inlet passage 18 from the outlet passage 19. In another embodiment, as shown in FIG. 5, the seal portion 20 includes a portion that is bent at an end of the plate 15 to have a curved shape, so as to tightly contact the pump cover 2. This also results in the inlet passage 18 being divided from the outlet passage 19. In embodiment, as shown in FIG. 6, the seal portion 20 includes a portion that is bent at an end of the plate 15 up and down in order to tightly contact the pump cover 2. Consequently the inlet passage 18 is separated from the outlet passage 19. As shown in FIGS. 4 to 5, the end of the plate 15 is sloped and curved at a predetermined angle with respect to a longitudinal direction of the plate 15 so as to tightly contact the pump cover 2 by a resiliency force of the plate 15 and the fastening torque between the pump casing 1 and the pump cover 2. The plate 15 may be made by stamped die or injection molding.

In operation, when the shaft 4 is rotated via the pulley 7 and the belt 8, driven by the internal combustion engine, the pump impeller 9 will rotate. Therefore, coolant in the circulation cavity 3 flows in the direction of the arrow in FIG. 1. Coolant in the by-pass passage 21 and the inlet passage 18 is delivered through to the pump to the outlet passage 19, and is discharged through the cylinder jacket. The plate 15 is disposed on the interface of the pump casing 1 and pump cover 2 and divides the circulated passage 3 into the inlet passage 18 and the outlet passage 19. As shown in an enlarged view of the portion A in FIG. 1, the seal portion 20 is effective to seal against leakage of coolant through the gap formed between the pump casing 1 and the pump cover 2. Hence, this construction prevents leakage in the circulation cavity 3 between into the inlet passage 18 and the outlet passage 19. Also this construction prevents a reduction in the efficiency of the pump due to leakage. Thus, the seal portion 20 is simplified in its construction and is formed easily because it formed simply by bending a part of the plate 15.

The present embodiments are to be considered as illustrative and not restrictive and the invention is not to be limited to the details given herein, but may be modified within the scope and equivalence of the appended claims. For instance, the seal portion 20 can be made of an elastic material such as a rubber or a synthetic resin affixed to the part of the plate 15 where an inteface of the pump casing 1 and the pump cover 2 contact the plate 15.

What is claimed is:

1. A water pump for an internal combustion engine comprising:

a pump casing, having a recess and a first interface;

a pump cover, having a recess and a second interface adapted for matching to said first interface of said casing;

a circulation cavity being formed by said recesses of said pump casing and said pump cover;

a plate positioned at a portion of said interface and dividing said circulation cavity into an inlet passage and an outlet passage; and a fluid seal, formed integrally as part of said plate, wherein said fluid seal is a bent part of said plate that is sloped.

2. The water pump for an internal combustion engine as set forth in claim 1, wherein said plate is formed from thin metal.

3. The water pump for an internal combustion engine as set forth in claim 2, wherein said plate is made by stamped die.

4. The water pump for an internal combustion engine as set forth in claim 1, wherein said plate is formed from thin synthetic resin.

5. The water pump for an internal combustion engine as set forth in claim 4, wherein said plate is made by injection molding.

6. A water pump for an internal combustion engine comprising:

a pump casing, having a recess and a first interface;

a pump cover, having a recess and a second interface adapted for matching to said first interface of said casing;

a circulation cavity being formed by said recesses of said pump casing and said pump cover;

a plate positioned at a portion of said interface and dividing said circulation cavity into an inlet passage and an outlet passage; and a fluid seal, formed integrally as part of said plate, wherein said fluid seal is a bent part of said plate that is sloped up and down.

7. The water pump for an internal combustion engine as set forth in claim 6, wherein said plate is bent with its end portion contacting said pump casing and a bottom portion of said end portion contacting said the pump cover.

8. A water pump for an internal combustion engine comprising:

a pump casing, having a recess and a first interface;

a pump cover, having a recess and a second interface adapted for matching to said first interface of said casing;

a circulation cavity being formed by said recesses of said pump casing and said pump cover;

a plate positioned at a portion of said interface and dividing said circulation cavity into an inlet passage and an outlet passage; and a fluid seal, formed integrally as part of said plate, wherein said fluid seal is a bent part of said plate that is curved.

9. A water pump for an internal combustion engine comprising:

a pump casing having a recess and a first interface;

a pump cover having a recess and a second interface adapted for matching to said first interface of said casing;

a circulation cavity being formed by said recesses of said pump casing and said pump cover;

a plate positioned at a portion of said interface and dividing said circulation cavity into an inlet passage and an outlet passage, and a seal comprising a bent portion of said plate for sealing against leakage from a gap formed between said inlet passage and said outlet passage of said interface.

10. A water pump for an internal combustion engine comprising:

a pump casing having a recess and a first interface;

a pump cover having a recess and a second interface adapted for matching to said first interface of said casing;

a circulation cavity being formed by said recesses of said pump casing and said pump cover; and a plate positioned at a portion of said interface and dividing said circulation cavity into an inlet passage and an outlet passage, wherein said plate comprises a portion that is bent for sealing against leakage from a gap formed between said inlet passage and said outlet passage of said interface.

11. The water pump for an internal combustion engine as set forth in claim 10, wherein said plate is formed from thin metal.

12. The water pump for an internal combustion engine as set forth in claim 11, wherein said plate is made by stamped die.

13. The water pump for an internal combustion engine as set forth in claim 10, wherein said plate is formed from thin synthetic resin.

14. The water pump for an internal combustion engine as set forth in claim 13, wherein said plate is made by injection molding.

15. A water pump for an internal combustion engine comprising:

a pump casing having a recess and a first interface;

a pump cover, having a recess and a second interface adapted for matching to said first interface of said casing;

a circulation cavity being formed by said recesses of said pump casing and said pump cover;

a plate positioned at a portion of said interface and dividing said circulation cavity into an inlet passage and an outlet passage; and a fluid seal formed integrally as part of said plate, said fluid seal comprising a bent part of said plate and a rubber portion affixed to said bent part.

* * * * *